US006062036A

United States Patent [19]

Hobelsberger

[11] Patent Number: 6,062,036

[45] Date of Patent: May 16, 2000

[54] DEVICE FOR MAKING ICE CUBES

[76] Inventor: Josef Hobelsberger, Fritz-Reuter-Strasse 9, Tostedt, Germany, D-21255

[21] Appl. No.: 09/051,327

[22] PCT Filed: Oct. 11, 1996

[86] PCT No.: PCT/EP96/04441

§ 371 Date: Nov. 23, 1998

§ 102(e) Date: Nov. 23, 1998

[87] PCT Pub. No.: WO97/14006

PCT Pub. Date: Apr. 17, 1997

[30] Foreign Application Priority Data

Oct. 12, 1995 [DE] Germany ..... 195 38 026

[51] Int. Cl.[7] ..... F25C 1/12

[52] U.S. Cl. ..... 62/347; 62/75; 62/356

[58] Field of Search ..... 62/75, 347, 348, 62/352, 356, 1

[56] References Cited

U.S. PATENT DOCUMENTS

| | | | |
|---|---|---|---|
| 3,091,194 | 5/1963 | Dickinson | 62/1 |
| 4,550,575 | 11/1985 | DeGaynor | 62/1 |
| 5,431,024 | 7/1995 | Hobelsberger | 62/75 |
| 5,634,344 | 6/1997 | Yamauchi | 62/75 |

*Primary Examiner*—William E. Tapolcai
*Attorney, Agent, or Firm*—Omri M. Behr, Esq.

[57] ABSTRACT

The invention relates to a device for producing ice cubes. It has a freezer unit (6) with a plurality of freezing regions (7) accessible from the outside of said unit (6) for one ice cube (1) each, a device (9) for supplying the freezing regions (7) with an excess of water to produce clear ice and a dispensing region (1)) for ice cubes (1) released from the freezer unit (6). Between the freezer unit (6) and the dispensing region (19) there is a device (18) for putting two ice cubes (1) together to form a composite cube (1(A+B)). Said device (18) has adjacent storage devices for the ice cubes (1) to be put together which can be moved together in order to place the ice cubes (1) with plane damp surfaces together, where the path between the combining device (18) and the dispensing region (19), and the dispensing region (19) itself, are cooled to a temperature below 0° C.

25 Claims, 8 Drawing Sheets

DEVICE FOR MAKING ICE CUBES

Figure 1:
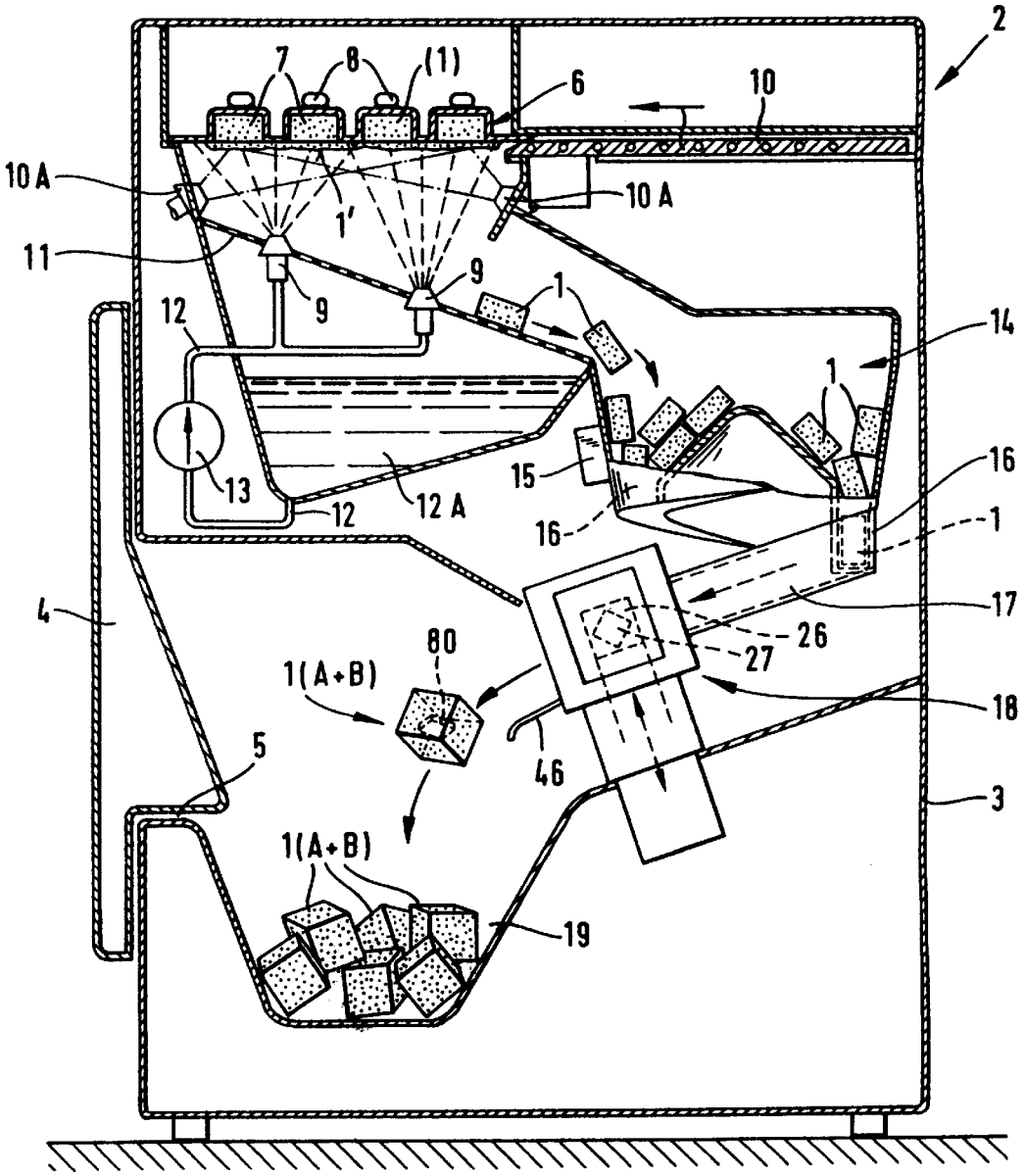

The invention relates to a device for producing ice cubes in accordance with the preamble of claim 1 and/or claim 20.

DE 41 30 055 A discloses composite pieces of ice, in particular ice cubes, which are formed by placing two ice cubes against one another with plane-parallel bearing surfaces and joining them in this position. To join them together, the bearing surfaces are thawed, joined together and bonded to one another by cooling and solidification of the thawed water. It is possible in this way to produce special optical effects in the interior of the composite ice cube, when air inclusions are formed there. Thus it is possible, for example, to stamp a logo in at least one of the bearing surfaces, which logo then becomes visible in the interior of the composite ice cube. The refraction of light at the ice/air transition at the level of this stamping results in a high-quality, silvery glistening effect, which, possibly in combination with the colour of the liquid, is visually attractive.

Also known are so-called ice-cube machines, which produce ice cubes in a very wide variety of shapes, for example cuboidal, conical, cylindrical, etc., shapes, by forming freezing zones or freezing compartments on a planar freezing unit, which zones or compartments are provided on their inside with a cooling surface, and to which water can be applied from their outside, in such a manner that only part of the water freezes, whereas an excess quantity runs off. As a result, the ice pubes are formed from clear ice, since the constant washing with excess water avoids ice inclusions which affect the appearance of the ice cube. After forming a suitably thick layer of ice, or after forming the envisaged ice cube, the cooling medium behind the cooling surface is switched off and replaced by a heating medium, which thaws the inner surfaces of the ice cubes, so that the ice cubes fall off the freezing unit and pass into a delivery region, where they are accessible from the outside to the user of the ice cubes. Owing to the high heat capacity of water, the ice cubes are preserved, albeit with moist surfaces, for a sufficiently long period in the delivery regions which is in communication with the surrounding environment. Obviously, the duration over which the delivered ice cubes remain usable can be increased by means of suitable heat insulation measures.

Naturally, such an ice-cube machine cannot be used to produce the composite ice cubes described at the outset.

The object of the invention is to create a device for producing ice cubes which functions in a similar manner to a conventional ice-cube machine and can be used to produce composite ice cubes of the type described at the outset automatically.

One solution to this object emerges from the characterizing features of claim 1.

The device which is connected between the freezing unit and the delivery region for joining together in each case two ice cubes allows these ice cubes to be combined so as to form a composite ice cube. To do this, in each case one of the ice cubes is supplied to a support device, and the support devices with the ice cubes positioned therein, are fed towards one another in such a manner that the planar, moist bearing surfaces of the two ice cubes are pressed against one another. Obstructing heat from the adjoining bearing surfaces into the body of the two ice cubes results in solidification of the surface water situated on these bearing surfaces and bonding of the ice cubes to form the composite ice cube. Following the formation of the composite ice cube, the latter is held at a temperature of below 0° C. over the transport path towards the delivery region and in the delivery region itself, in order to ensure that the ice cubes only begin to melt slowly in the glass, so that the visual effect between the bearing surfaces is retained for as long as possible. This visual effect may be caused by simple air inclusions with a silvery shimmer between non-planar bearing surfaces, or can be produced in a controlled manner, for example by stamping.

If, in accordance with claim 2, conveyor slides are arranged between the freezing unit and the support devices, the ice cubes can be conveyed to the support devices easily and without interference essentially without using moving parts.

In this case, it is preferred, in accordance with claim 3, to provide stop elements for the ice cubes, which stop elements can move into and out of the path of the ice cubes and allow the ice cubes to be fed to the support devices individually in a cyclical manner. In this way, a large number of ice cubes can be moved along the conveyor slides simultaneously while nevertheless ensuring that the ice cubes are fed individually to the support devices.

If the stop elements are arranged downstream of the support devices in the direction of transport of the ice cubes, they may simultaneously serve to position the ice cubes on the support devices themselves.

If the support devices have rest surfaces for the ice cubes which are arranged at an angle to the horizontal, in the same direction as the conveyor slides, the reliability of the feed is increased by the fact that there is always a feed gradient which ensures that operation proceeds without interference under all circumstances.

In a particularly preferred configuration of the invention, the latter is distinguished by a device for removing excess water from the bearing surfaces of the ice cubes before forming the composite ice cube. This reliably prevents excess water from penetrating into recesses in the planar bearing surfaces and freezing in these recesses, so that the desired sparkling effect would not have its full effect when light is refracted at the ice/air interface. This ought to ensure that while a thin layer of moisture is present on the bearing surfaces in order for them to be joined together, ensuring intensive bonding of the ice cubes during freezing, excess water, which could penetrate into recesses in the planar bearing surfaces, is avoided.

Preferably, the device for removing excess water has at least one compressed-air nozzle which is inclined towards the bearing surfaces. This nozzle simply blows away excess water, the high, substantially distance-independent cleaning force of a compressed-air jet ensuring reliable cleaning in a simple manner. The compressed air is preferably held at a temperature of above 0° C., so that the bearing surfaces are left in a slightly moist condition under all conditions.

Particularly preferably, a stamping punch, which can be pressed onto at least one of the bearing surfaces, can be arranged between the bearing devices. As a result, it is possible in a manner which is relatively simple in terms of design and production engineering, to make a precisely defined depression, such as a logo or the like, in the previously planar bearing surface of one of the ice cubes or both ice cubes, immediately before they are joined together. The device for generating the pressure for the joining operation can simultaneously be used for the stamping operation. The stamping tool is easy to exchange, and consequently the device according to the invention can easily be adapted to produce a large number of different ice cubes.

Preferably, the stamping punch has a heating device of adjustable output, in order to be able to achieve optimum conditions depending on the conditions of the individual case, i.e. the shape and surface and depth of the stamping, the temperature of the ice cubes, etc. Generally, a stamp of very shallow depth, even in only one bearing surface, is generally quite sufficient to produce the desired visual effects.

Preferably, the stamping punch has a levelling plate which surrounds the stamping surface and the surface of which is held at a temperature of above 0° C. In this way, the preparation of the bearing surface surrounding the stamping figure for being joined with a moistened bearing surface takes place at the same time as the stamping operation. If, moreover, the rear side of the stamping punch is designed as a levelling plate, the surface of which is held at a temperature of above 0° C., and can be placed against the bearing surface which is not to be stamped, the same effect can also be achieved on the opposite bearing surface, even if the latter is not to be stamped, so that a particularly good bond is achieved when freezing the joining water by moistening both bearing surfaces.

If a levelling plate can be placed against at least one of those surfaces of the composite ice cube at which the bearing surfaces of the ice cubes emerge, the surface of which levelling plate is held at a temperature of above 0° C., this surface is also levelled after the ice cubes have been joined together to form the composite ice cube, thus avoiding the presence of a small discontinuity at the line where the bearing surfaces emerge. When the ice cubes are subsequently melted in the beverage, a small groove, or the like, of this nature could represent a preferred point of attack for the warm liquid to be cooled and hence to the uniform appearance of the composite ice cube becoming impaired.

In a particularly preferred configuration of the invention, that surface of each ice cube which is situated opposite to the cooling surface on the freezing unit is designed to be plane-parallel to the cooling surface. This ensures that each ice cube is produced with two mutually opposite plane-parallel surfaces, in such a manner that when a plane-parallel surface is received on the rest surface of the associated support device, the opposite bearing surface is also arranged correctly and parallel to the bearing surface of the opposite ice cube, with which it is intended to form the composite ice cube. In this way, it is possible to avoid structural expenditure in the region of the support devices so as to achieve parallel bearing surfaces on the ice cubes.

To this end, a levelling plate, the surface of which is held at a temperature of above 0° C., can preferably be placed against that surface of the ice cubes which is situated opposite to the cooling surface on the freezing unit, in the position in which the ice cubes are on the freezing unit. This makes it possible to produce the ice cubes in a completely conventional manner, accepting an outer surface which is not plane-parallel to the cooling surface, and then to produce the desired plane-parallel surface for a large number of ice cubes in one operation by placing the levelling plate against them and melting the outsides of the ice cubes until they are flat.

In a particularly preferred configuration of the invention, a sorting device is provided downstream of the freezing unit, in the direction of transport of the ice cubes, which sorting device removes those ice cubes which would be/are aligned in the support devices in a position other than that in which their planar surface is in the position of the bearing surface. This makes it possible to avoid a structurally complex, active alignment of the ice cubes, since separating out ice cubes which are not aligned correctly ensures that only correctly aligned ice cubes are supplied to the support devices.

In a particularly preferred configuration of the invention, the removed ice cubes can be recycled and returned to one of the support devices. This completely avoids any losses caused by the sorting operation. Every ice cube is kept circulating until eventually, by chance, it is correctly oriented, and it is then supplied to the support device.

In a preferred configuration of the invention, the sorting device is formed integrally with the support devices. This avoids additional outlay on positioning the ice cubes for the purposes of sorting, and the positioning in the support devices which is required in any case is also used for the sorting operation.

If the ice cubes can be aligned in the support devices with their bearing surfaces plane-parallel, it is ensured that the ice cubes are always joined together cleanly to form the composite ice cube. For this purpose, it is possible, for example, for heated levelling surfaces to act on the bearing surfaces for a period of time which is suitable for bringing them into a plane-parallel position even under unfavourable conditions. Although this causes the production rate of the device to fall, and also reduces the precision of the composite ice cubes produced, since they may have non-parallel outer surfaces, there is a considerable saving on the effort expended on the production of plane-parallel surfaces and for aligning the ice cubes with respect to the support devices. Moreover, such a procedure is also preferred if it is desired to join semi-cylindrical or semi-conical ice cubes to form cylindrical or conical composite ice cubes, or if it is intended to produce other ice cube shapes which differ from the shape of a cube. Even in these cases, if the bearing surfaces of the ice cubes are aligned plane-parallel in the support devices before being joined together, a clean join is sufficient, irrespective of the geometry of the remaining surfaces of the ice cubes.

Another solution to the object set emerges from the characterizing features of claim 20. Unlike the solution according to claim 1, in this case individual composite ice cubes are not produced from in each case one pair of ice cubes one after another, but rather the alignment of the ice cubes on the freezing unit is used to produce composite ice cubes, in combination with suitable mating ice cubes, before the individual ice cubes leave the freezing unit, To do this, two freezing units, which are aligned in pairs in parallel planes, are provided, those faces of the ice cubes which face away from the cooling surface of at least one of the freezing units are acted on by means of a stamping plate, the surface of which is held at a temperature of above 0° C., the two freezing units can be moved towards one another in such a manner that the planar, moist bearing surfaces, which face away from the cooling surfaces, of the ice cubes can be pressed against one another to form composite ice cubes, and the transport path between the freezing units and the delivery region, as well as the delivery region itself, are cooled to a temperature of below 0° C.

In this way, a plurality or multiplicity of ice cubes are stamped simultaneously, and are then combined with a mating ice cube all at once, to form the composite ice cube, and the composite ice cubes which have already been finished in this way are then removed from the freezing units and can fall into a delivery shaft.

This solution of the object in accordance with claim 20 requires only a relatively minor structural change to conventional ice-cube machines, and production can take place with a high output and a high level of functional reliability. However, such a device is less flexible with regard to the desired stamping, since the stamping plate must have stamping zones for all the bearing surfaces to be stamped next to one another. Such a complex stamping plate is considerably more expensive to exchange by comparison with exchanging a stamping punch for a single ice cube, The solution according to claim 20 is therefore suitable for applications in which the same stamping is produced over a relatively long period of time, with a high output.

Preferably, the rear side of the stamping plate is designed as a levelling plate, the surface of which is held at a temperature of above 0° C. In this way, the bearing surfaces of the multiplicity of oppositely situated ice cubes can be levelled using the levelling plate and thus prepared for being joined together. Naturally, here too the front side of the stamping plate between the stamping zones may also preferably be used as a levelling plate.

Furthermore, the device preferably has a device for removing excess water, as has already been explained in principle above, in order to ensure that each of the stamping depressions does indeed contain air when joined together.

Figure 3:
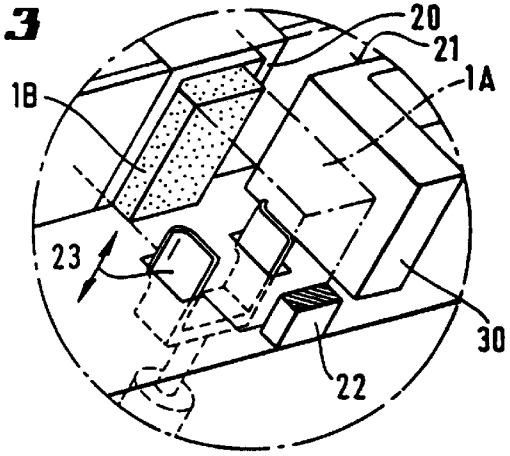
Figure 2:
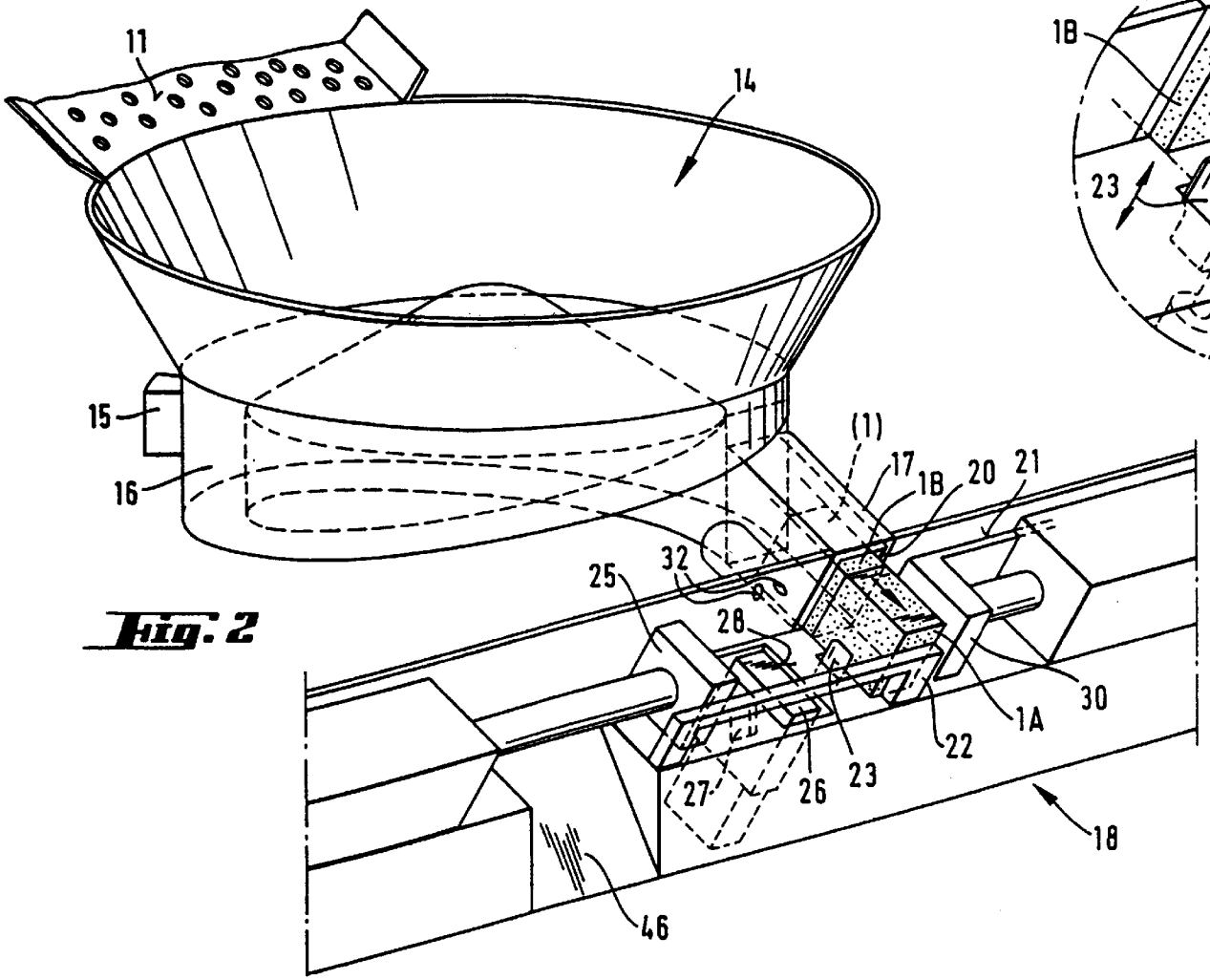
Figure 4:
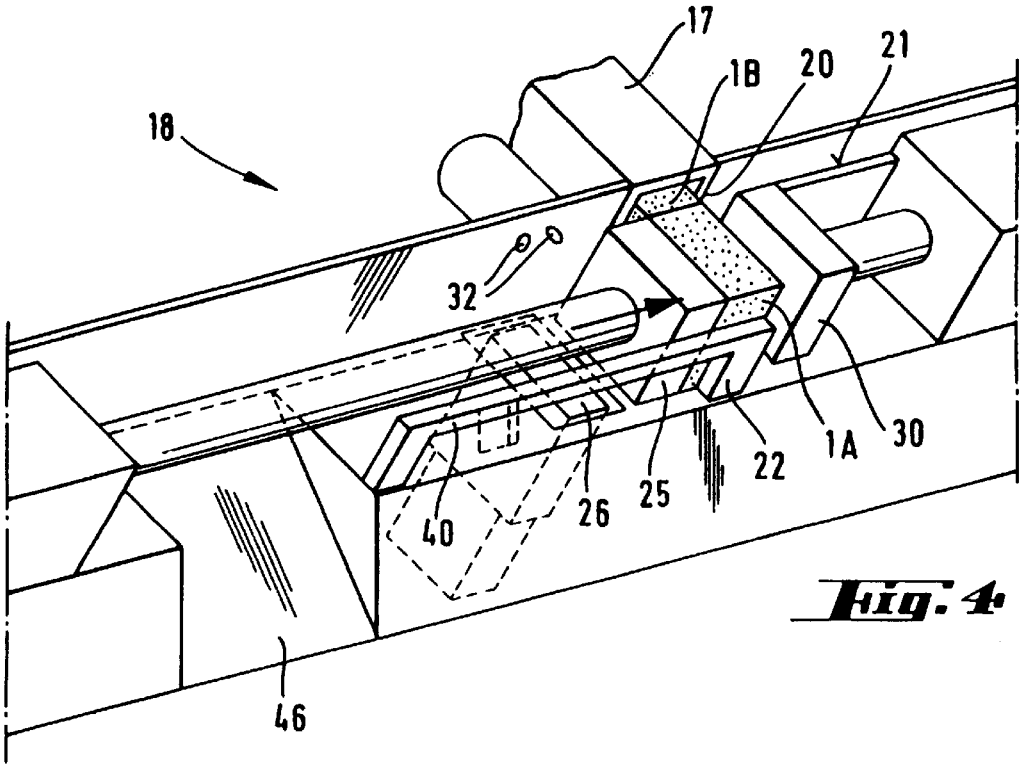
Figure 5:
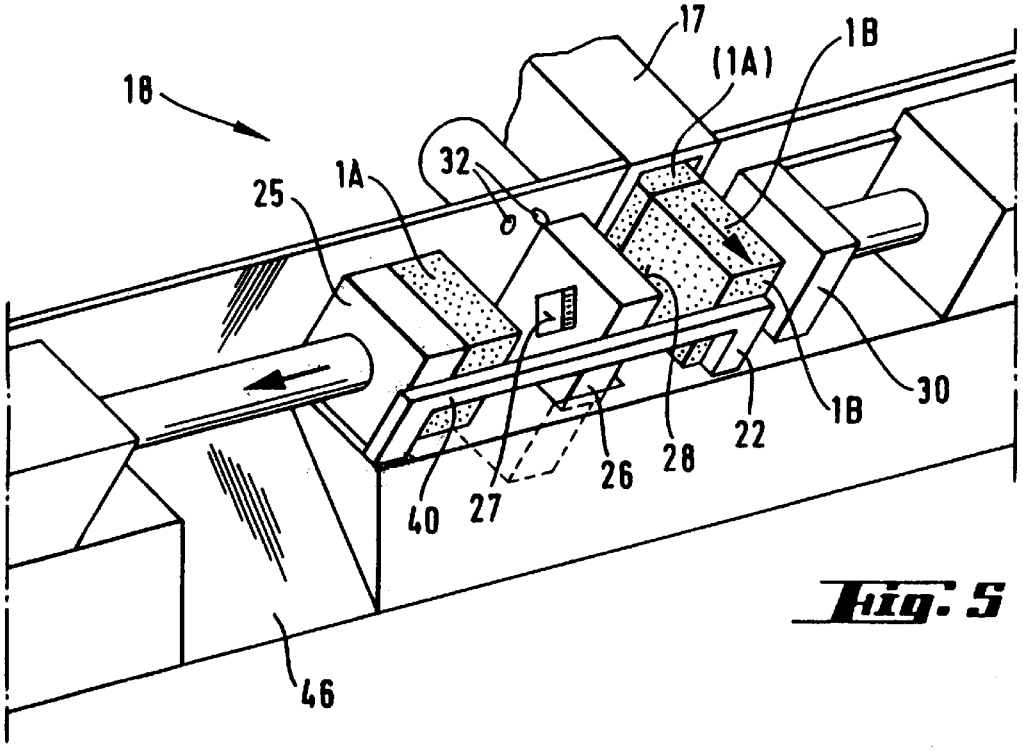
Figure 6:
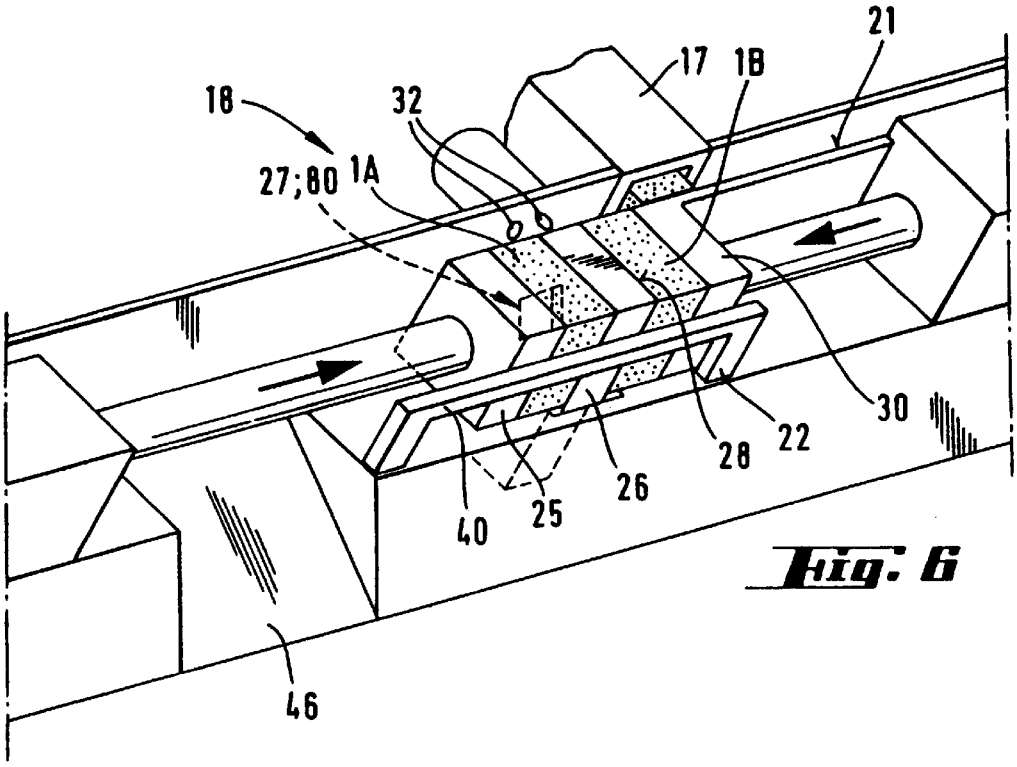
Figure 7:
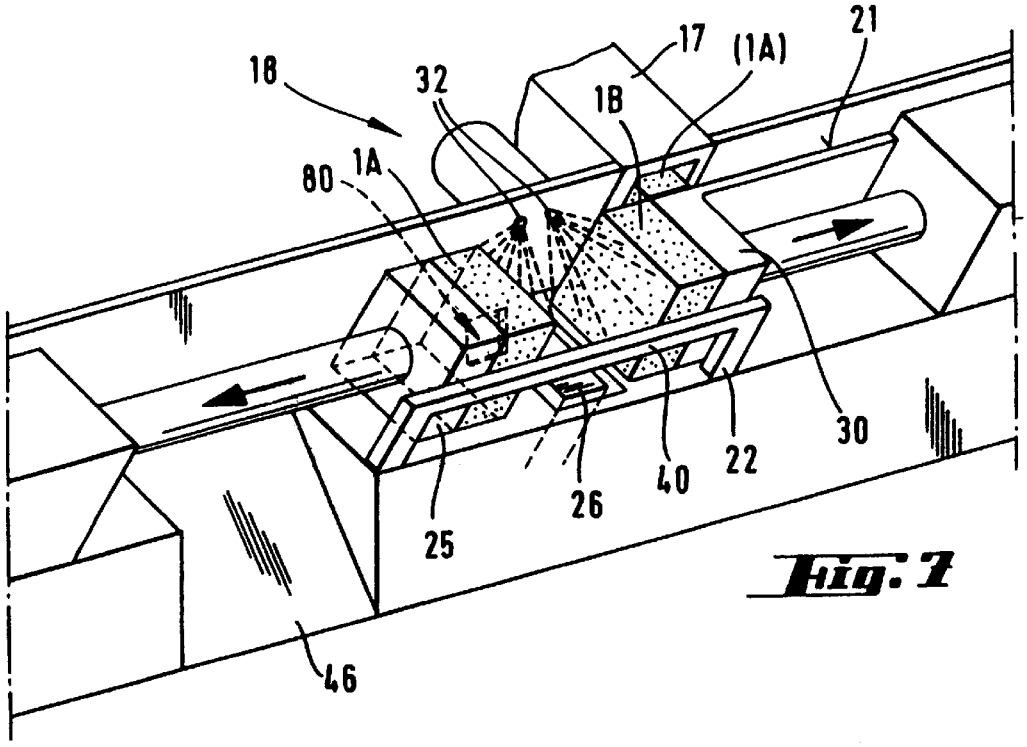
Figure 8:
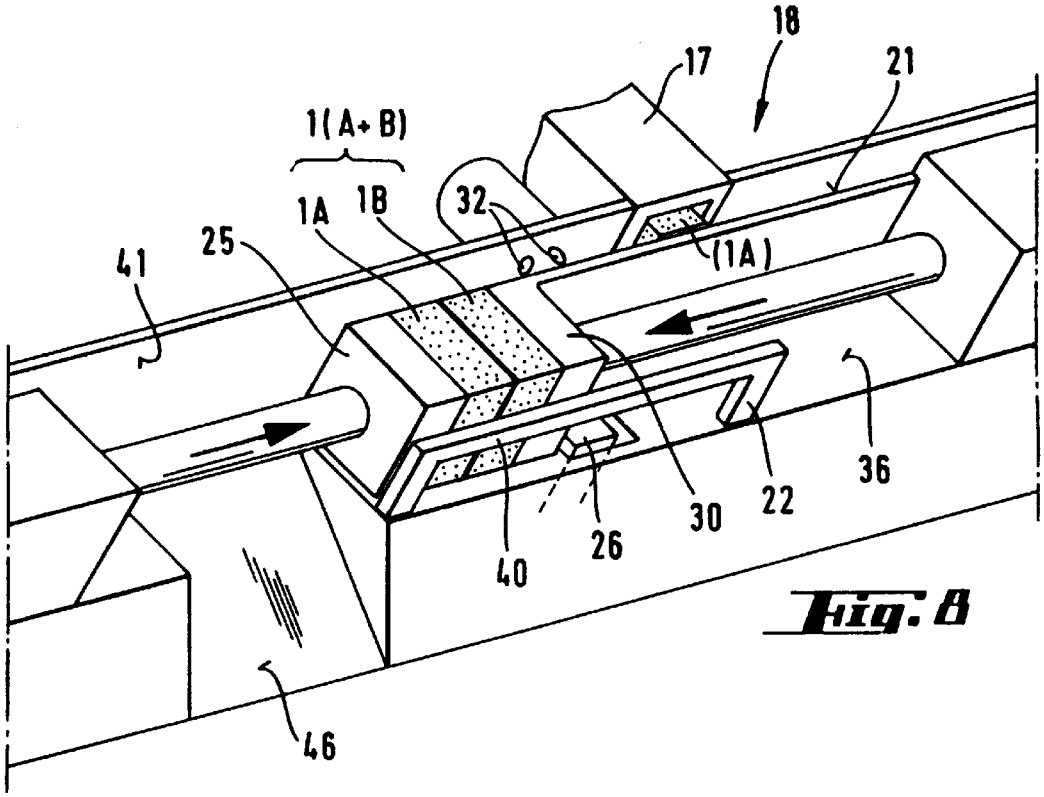
Figure 9:
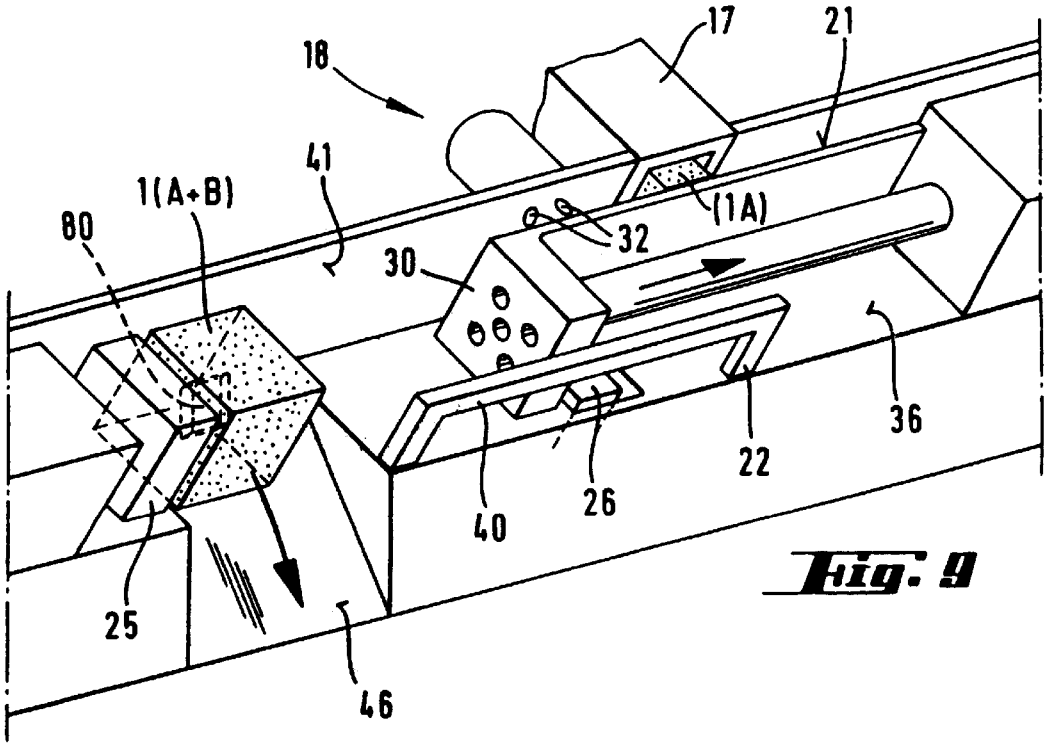
Figure 10:
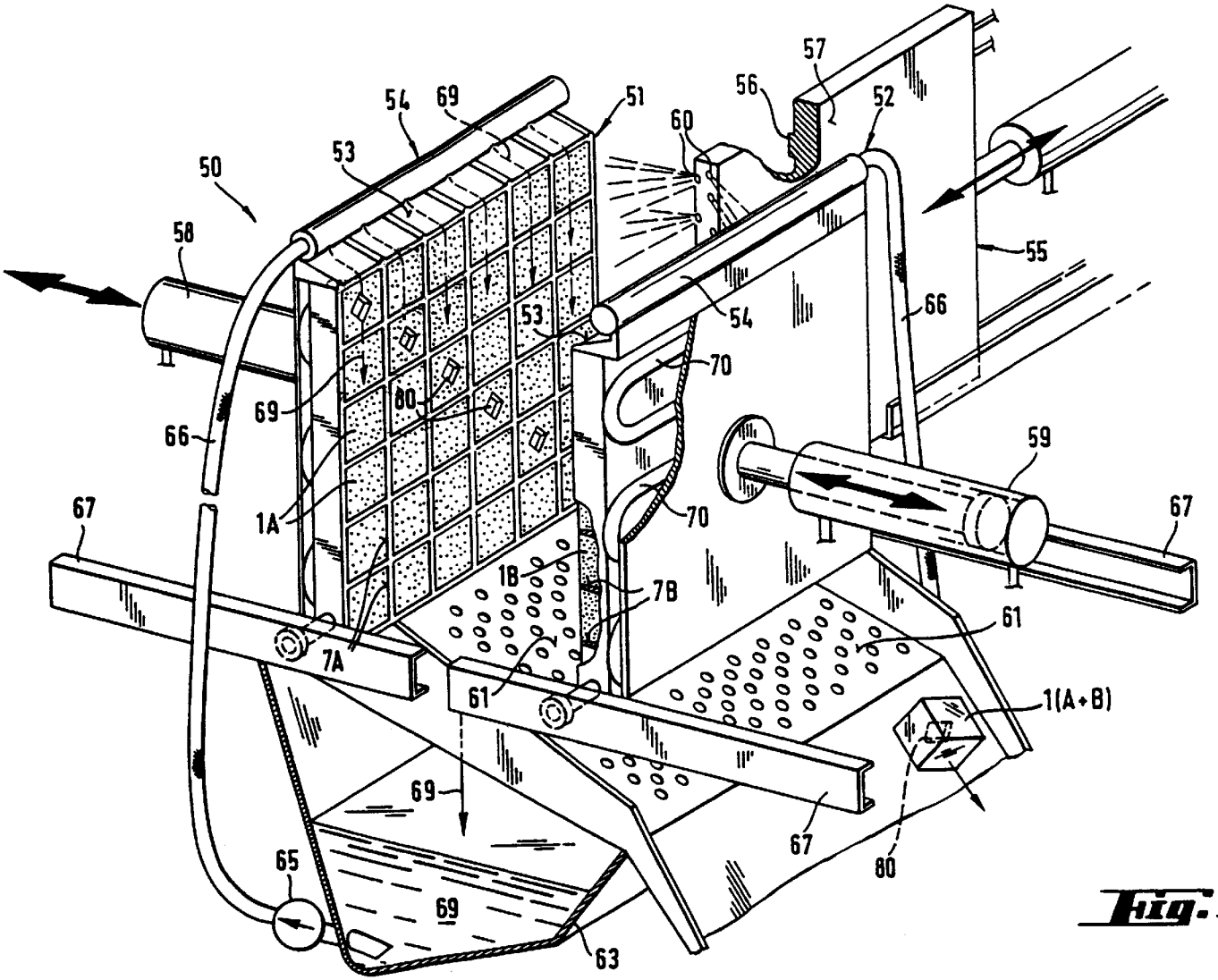
Figure 11A:
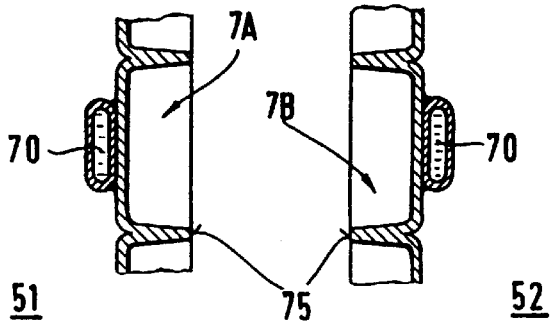
Figure 11B:
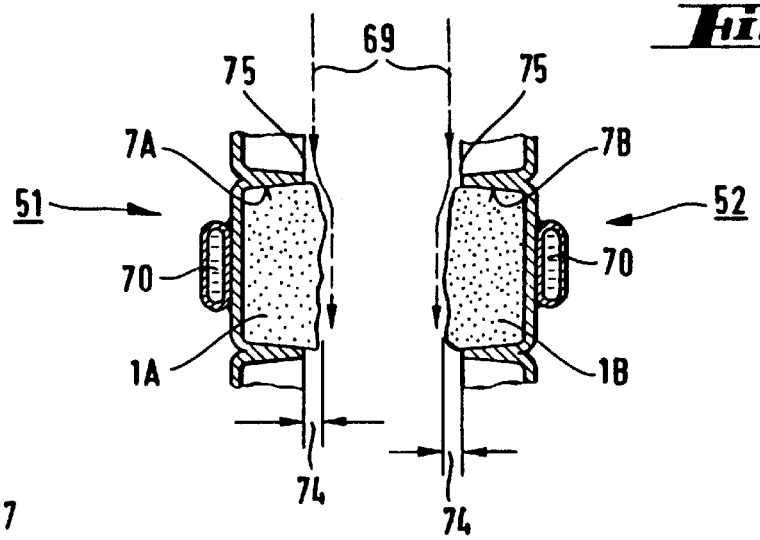
Figure 11C:
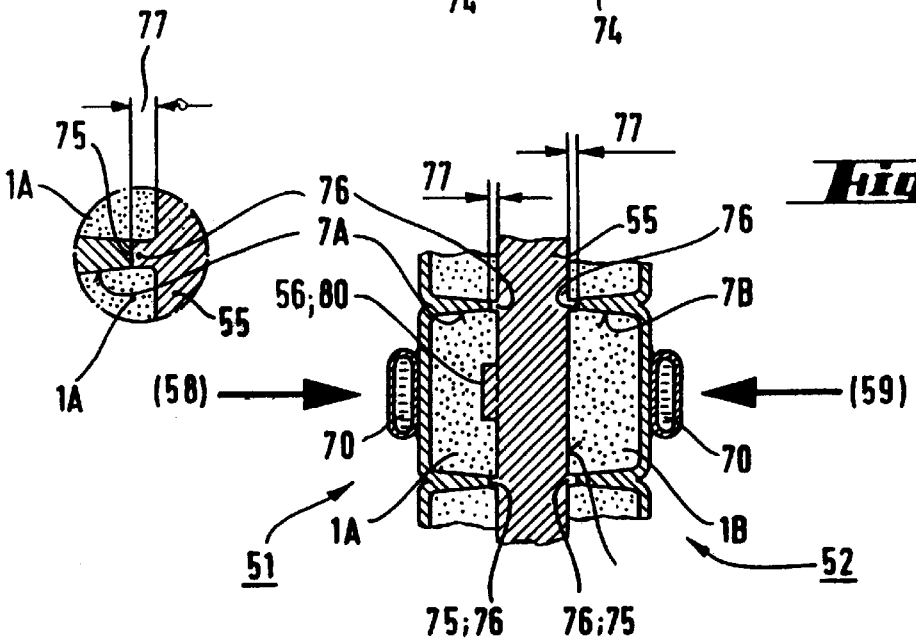
Figure 11D:
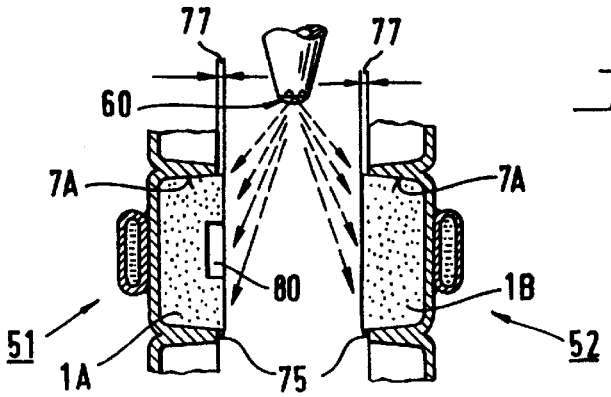
Figure 11E:
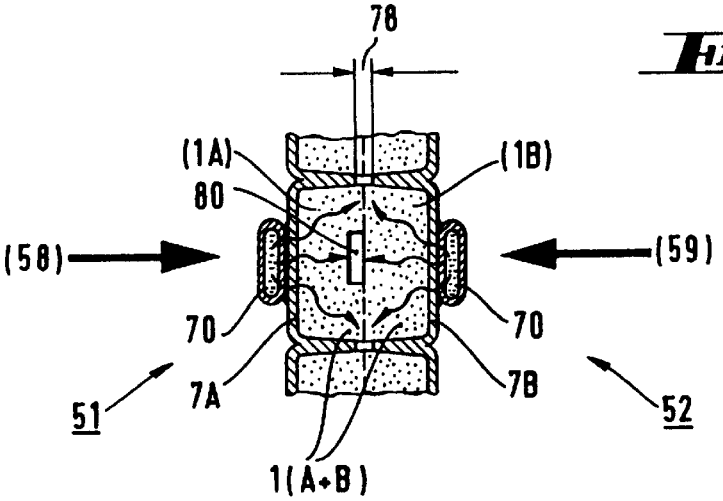
Figure 11F:
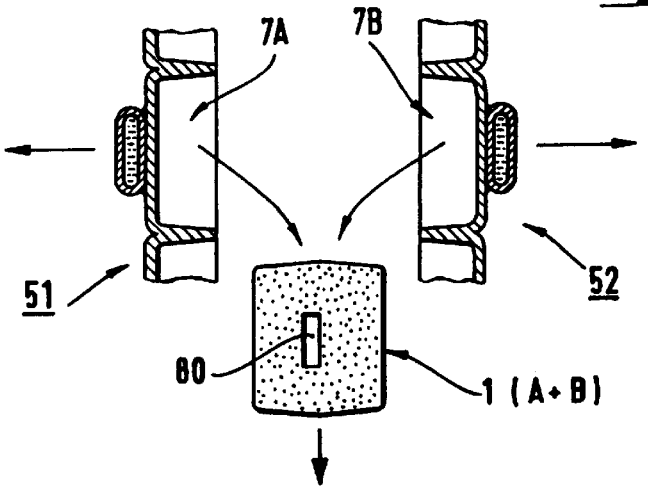

Further details, features and advantages of the invention will emerge from the following description of embodiments which is given with reference to the drawing, in which:

FIG. 1 shows a vertical section through the complete ice-making machine in accordance with a first embodiment of the invention, FIG. 2 shows a perspective illustration of a screening slide, a sorting device for the ice cubes, and an adjoining support device, in the latter illustrating the situation where a (left-hand) ice cube 1A is supplied to the support device, FIG. 3 shows an enlarged illustration of a detail of the support device in accordance with FIG. 2, showing stop elements and adjustment elements for three directions, FIG. 4 shows the movement of a left-hand suction/pressure head onto the (left-hand) ice cube 1A, and the suction thereof, FIG. 5 shows the left-hand ice cube 1A which has moved into the left-hand limit position, the (right-hand) ice cube 1B which has subsequently slid into position, and the position, now raised between them, of a stamping and levelling head, FIG. 6 shows the hot-pressing situation of the two ice cubes 1A (left-hand) and 1B (right-hand) to form the relief and the levelling, FIG. 7 shows the blow-off situation, after pressing, in the position in which the two ice cubes 1A and 1B are moved apart, with the stamping and levelling head having been lowered again, the excess film of water being blown off by means of compressed air, FIG. 8 shows the joining of the two ice cubes 1A and 1B by pressing them together to form a clear ice cube 1(A+B), FIG. 9 shows the ejection situation of the finished, joined-together clear ice cube 1(A+B), FIG. 10 shows a perspective illustration of a further embodiment of the invention, in which, according to the invention, a plurality of clear ice cubes 1(A+B) are produced simultaneously; FIG. 10 depicts two freezing units which are aligned in pairs in parallel planes, the two of them each having an identical number of freezing moulds, each for an identical number of ice cubes 1A and 1B, respectively, which are situated precisely opposite one another, the freezing units being arranged in guides, so that they can be moved towards and away from one another, and it being possible to introduce and remove, between the two freezing units, means for treating the opposed ice cube surfaces, FIG. 11*a* shows a diagrammatic illustration, in the form of an excerpt, of an individual chamber-pair region of the freezing units for producing the clear ice cubes 1(A+B), specifically the situation in which the chambers of the freezing units have been moved apart and emptied, i.e. demoulded, and are cold, FIG. 11*b* shows the ice-filled moulding chambers after the end of ice formation, FIG. 11*c* shows the stamping and smoothing of two mutually opposite surfaces of the ice cubes 1A and 1B by means of a stamping and smoothing plate, FIG. 11*d* shows how excess water is blown off, FIG. 11*e* shows the joining operation to form a clear ice cube 1(A+B) by means of pressure and subsequent heating of the ice chambers for the purpose of thawing at the mould surfaces in order to allow ejection, and FIG. 11*f* shows how the moulding chambers are moved apart and the finished clear ice cubes 1(A+B) are ejected (fall out).

The ice-making machine 2 according to the invention, in accordance with FIG. 1, has a housing 3, which on the front side is provided with an opening 5, which can be closed off by means of a door 4, allowing removal of clear ice cubes 1(A+B).

The upper part of the figure shows a design, which is conventional per se, of a freezing unit 6, which has freezing chambers 7.

These chambers are cooled, or heated when required, by means of a medium which flows in lines 8.

To form ice, atomization nozzles 9 are arranged below the freezing unit 6, which nozzles spray atomized water upwards into the freezing chambers 7, this water then freezing to form ice cubes 1.

When the freezing process has been completed, a warm levelling plate 10 is slid beneath the freezing unit 6, from the right-hand side in the illustration selected, in such a manner that the excess ice formation 1 is melted off and a completely planar ice surface is produced.

Then, the levelling plate 10 is withdrawn again, and air nozzles 10A can be used to blow off the excess surface water.

At the same time, the freezing chambers 7 are heated by the action of the lines 8 containing warm medium, so that the thawing effect at the mould surfaces causes the ice cubes 1 to fall onto a screening slide 11.

The excess water penetrates through screening openings in the screening slide 11, is collected in a container 12A and can be fed back to the freezing unit 6 via a line 12 and a pump 13.

The ice cubes 1 formed in this way pass into a sorting device 14, which is encapsulated and in which the individual ice cubes 1 can be held at a specific temperature and surface moisture level, in order to absolutely prevent them from sticking to one another in an undesired manner.

A vibrator 15 assists with this aim and also with conveyance through the sorting device 14.

The individual ice cubes 1 then pass into a helical duct 16, which is dimensioned in such a way that the individual ice cubes 1 are moved into a correct on-edge position.

The helical duct 16 opens out into a straight duct 17, through which each individual ice cube 1 is supplied to the support device 18.

There, two ice cubes 1, which will later be referred to as the left-hand ice cube 1A and the right-hand ice cube 1B, are in each case treated separately, one of the two ice cubes being provided with a relief 80 (depression), and are then combined to form a single ice cube 1(A+B) produced in the form of clear ice with a visible motif/relief 80 in the form of an enclosed air bubble.

The ice cubes 1(A+B) produced in this way fall into a collecting trough 19 situated in the cool region, and can then be removed through the removal opening 5 in the manner described above.

FIG. 2 shows the above-described screening slide 11, as well as the sorting device 14, which is adjoined by the straight feed duct 17 for the individual ice cubes 1.

In the situation in accordance with FIG. 2, the so-called first, i.e. left-hand, ice cube 1A is introduced directly into the support device 18, in such a manner that a movable drag stop 21, which was originally situated in front of the opening 20 of the duct 17, was moved to the right, thus freeing the opening 20.

As a result, the left-hand ice cube 1A falls, under the force of gravity (inclined arrangement) down onto the stop 22 in an accurate position.

At the same time, or previously, a guide fork 23 is introduced from below into the working region of the support device 18 in order to effect positioning in the transverse direction, as illustrated in detail in FIG. 3.

The ice cube 1A is fixed precisely in three directions by means of this guide fork 23 and the stop 22.

The next operating step is illustrated in FIG. 4, which is such that a pressure/suction head 25 is moved from the left onto the left-hand surface of the ice cube 1A.

This component applies subatmospheric pressure, in such a manner that it sucks the ice cube 1A onto it and conveys it into the left-hand limit position in accordance with FIG. 5.

At the same time, a further ice cube 1B, the so-called right-hand ice cube 1B, has fallen out of the feed duct 17 and likewise comes to bear against the stop 22.

Shortly afterwards, or at the same time, the stamping and levelling head 26 moves upwards, from below, into the operating region of the support device 18, in such a manner that its outer contours come into axial alignment with the two ice cubes 1A and 1B.

On the left-hand side, which faces towards the ice cube 1A, the stamping and levelling head 26 has a projecting relief 27, while on the right-hand side, which faces towards the ice cube 1B, the stamping and levelling head 26 has a levelling plate 28, in the form of a planar plate 28.

Both theme surfaces are heated, so that when the arrangement 25-1A-26-1B-30 is moved together, in accordance with FIG. 6, the two ice cubes 1A and 1B are respectively stamped and levelled and thawed on their surfaces which face one another, the reference numeral 30 denoting a further pressure/suction head which is arranged to the right of ice cube 1A.

In the blowing-off situation in accordance with FIG. 7, the two pressure/suction heads 25 and 30 have moved slightly apart again, bringing the ice cubes 1A and 1B with them. The stamping and levelling head 26 is then moved downwards again, out of the effective region of the support device 18, and air nozzles 32 are used to blow excess water off the ice surfaces which are now directly opposite one another.

This operation makes the mutually facing ice surfaces substantially dry, and clears excess thawed water from the relief 80.

The residual moisture on these surfaces is set in such a manner that the two ice cubes can be combined and frozen together, as shown in FIG. 8, to form a single clear ice cube 1(A+B), in such a manner that the two suction/pressure heads 25 and 30 are moved towards one another and the ice cubes 1A and 1B are pressed together, with the result that a single clear ice cube 1(A+B) is produced.

In order to prevent further ice cubes 1A and/or 1B from being able to slide down through the duct 17 during this pressing operation, the drag stop 21 is arranged on the pressure/suction head 30.

In order to ensure that the ice cubes 1A and 1B are brought together precisely during all the operations, they are guided towards one another over three surfaces, namely on the base surface 36 of the support device 18 and by means of a guide bracket 40, which adjoins the stop 22, and finally by means of a wall 41 on the rear side of the support device 18.

After they have been joined together to form a clear ice cube 1(A+B), the right-hand pressure/suction head 30 moves back into its right-hand initial position, as indicated in FIG. 9 by the arrow, while the left-hand pressure/suction head 25 moves to the left, pulling the clear ice cube 1(A+B) which is sucked onto it into the position of an ejector slide 46.

There, a brief switch from suction action to excess-pressure action ejects the clear ice cube 1(A+B), which falls into the ejector slide 46, from where, as illustrated in FIG. 1, it falls into the collection and removal trough 19.

FIG. 10 shows the further embodiment of the invention, in the form of an ice-making machine 50, in which, in accordance with the invention, a plurality of clear ice cubes 1(A+B) are produced.

The ice machine 50 has freezing units 51, 52 which are aligned in pairs in parallel planes. Each freezing unit contains an identical number of moulds 7A and 7B, in which ice cubes 1A and 1B are produced.

In this case, the water 69 required for this purpose flows in a form known per se over a roof-shaped slope 53 from a feed tube 54, passing over the inner fronts of the units 51 and 52.

In the process, the clear ice cubes form in the chambers 7A and 7B. Here too, as in the case of the ice formation in accordance with FIG. 1, some excess ice is formed, projecting beyond the chamber region (cf. FIG. 11*b*).

Once this operation has been concluded, a stamping and levelling plate 55 slides in from the right, between the two freezing units 51 and 52.

This plate has relief-like projections 56 on one side and a smooth levelling surface 57 on the other side.

The stamping and levelling plate 55 is heated, and after it has been moved into position, the two freezing units 51, 52 are moved together, for example by means of pneumatic cylinders 58 and 59, and are pressed together with the stamping and levelling plate 55 between them.

In this process, as illustrated, depressions, i.e. reliefs 80, are melted or stamped into the ice cubes 1A, and both sets of ice cubes 1A and 1B are levelled and thawed on their mutually facing surfaces.

Then, a further device, or else the same stamping and levelling plate 55, can be used to blow off the excess water or the film of water, for which purpose air nozzles 60 are provided.

The excess water runs downwards, through the openings in a screening slide 61, and is collected in a collection container 63, from where it can be fed back to the feed tubes 54, via pumps 65 and hoses 66, to form further ice in the freezing units 51, 52.

The freezing units 51, 52, which can be displaced on guides 67, are now moved back towards one another, and the total number of all the ice cubes 1A and 1B are pressed together to form clear ice cubes 1(A+B).

Then, the lines 70, through which cooling medium has hitherto been flowing, are filled with heating medium, so that the now combined ice cubes 1(A+B) now begin to thaw at the surfaces of the moulds 7A and 7B, so that after the units 51 and 52 are moved apart again by means of the pneumatic cylinders 58, 59, the combined clear ice cubes 1(A+B) fall down onto the screening slide 61 and, from there, as shown in FIG. 1, pass into the collecting and removal trough 19.

The above-described steps for ice formation and joining are explained in FIGS. 11*a* to 11*f* using the representative example of a single pair of moulds 7A and 7B.

In FIG. 11*a*, the two water-free and ice-free mould halves 7A and 7B of the freezing units 51 and 52 are at a distance apart.

In accordance with FIG. 11*b*, the water 69 flows over the moulds 7A and 7B from above, with the result that the ice cubes 1A and 1B are frozen.

Then, in accordance with FIG. 11*c*, the stamping and levelling plate 55 is introduced, which plate is heated. The stamping and levelling are carried out by means of the cylinders 58 and 59— depicted symbolically here by means of arrows—, so that on one side (ice cube 1A) a relief 80 and a smooth surface are formed, and on the other side (ice cube 1B) a smooth surface is produced.

Then, in accordance with FIG. 11*d*, the freezing units 51, 52 are moved apart and the stamping and levelling plate 55 is withdrawn.

It can be seen in FIG. 11*c* and FIG. 11*d* that the operation of melting off excess ice 74 in accordance with FIG. 11*b* does not have to take place right down to the outer edge 75 of the moulds 7A and 7B.

Rather, it is advantageous for a small ice projection 77 to remain, in such a manner that during the subsequent pressing of the ice cubes 1A and 1B to form a single ice cube 1(A+B) in accordance with FIG. 11*e*, this ice projection adds up to form a gap 78 between the moulds 7A and 7B, guaranteeing a force-fitting contact between the ice cubes 1A and 1B.

In order to eliminate burrs on the ice cubes 1A and 1B, the stamping and levelling plate 55 may have deburring webs 76 on both sides, which webs melt off the excess ice 74 in the region of the mould outer edges 75 without leaving any residue (FIG. 11*c* and FIG. 11*d*). Before moving the individual ice cubes 1A and 1B together, excess remaining water is blown off by means of the air nozzles 60 (FIG. 11*d*).

FIG. 11*e* shows the operation of joining the ice cubes to form a single ice cube 1(A+B).

Then, heating medium is applied to the media lines 70, thus thawing the surfaces of moulds 7A and 78, so that in accordance with FIG. 11*f* the combined clear ice cube 1(A+B), which includes a decorative air bubble or relief 80, can fall down onto the screening slide 61 after the freezing units 51, 52 have been moved apart.

The invention is not limited to the examples illustrated.

Thus, in a further embodiment, it may be provided to combine not just two ice cubes 1A and 1B with the inclusion of a relief, but rather three ice cubes, namely 1A, 1B and 1C, with the result that two parting/joining surfaces are produced, it being possible for different motifs, in the form of reliefs or air bubbles, to be present in each of these two surfaces.

For example, "Coca", could be situated in one joining plane and "Cola" in the other joining plane.

In this case, joining can in principle take place in the manner described with reference to FIGS. 2–9.

In a further variant, there may be provision, for example, for modifying the ice-making machine 50 in accordance with FIG. 10 as follows:

Instead of a stamping and levelling plate 55, which has a multiplicity of raised reliefs 56 corresponding to the number of all the ice cubes formed in the freezing units 51 and 52, only a small relief-producing and levelling tool is introduced, which in each case only melts a depression 80 in a single ice cube 1A and levels the respectively opposite ice cube 1B.

Then, an automatically controlled manipulating device is used to move this tool horizontally and vertically in the appropriate coordinates, so that all the ice cubes 1A and 1B are treated in a corresponding manner one after the other.

The advantage here is that only minor forces are required to treat the individual ice cubes 1A and to prepare them for joining.

When all the ice cubes 1A and 1B have been prepared, the two freezing units 51, 52 are moved back together and, as described above, all the ice cubes are combined jointly to form clear ice cubes 1(A+B), which are then ejected and deposited in the collection container prior to being removed.

I claim:

1. A device for producing ice cubes comprising a) a freezing unit (6) having a plurality of freezing zones (7) said freezing zones being accessible from the outside of said freezing unit (6) each of said zones being designated for the production of one ice cube (1), b) water application means (9) for applying an excess quantity of water to said freezing zones (7) in order to produce clear ice and c) a delivery region (19) for receiving ice cubes (1) after removal thereof from freezing unit (6)

further comprising joining means (18) arranged between said freezing unit (6) and said delivery region (19) for joining together two ice cubes (1) to form a composite ice cube (1(a+b)) and a transport path between said joining means (18) and said delivery region (19), wherein said joining means (18) comprises support devices for said ice cubes (1) to be joined together, said support devices being arranged in proximity to one another and being moveable towards one another along said transport path whereby planar, moist mutually facing contact surfaces of said ice cubes (1) are contactable against one another and further comprising cooling means for,cooling said transport path as well as the delivery region (19), to a temperature of less than 0° C.

2. The device according to claim 1 further comprising conveyor slides (11,16, 17) arranged between said freezing unit (6) and said support devices.

3. The device according to claim 1 further comprising stop elements (21, 23) for said ice cubes (1) said stop elements being movable into and out of the path of said ice cubes (1) to allow said ice cubes (1) to be individually and cyclically fed to said support devices.

4. The device according to claim 3 wherein said stop elements (21, 23) are arranged downstream of said support devices in the direction of said transport path for transport of ice cubes (1).

5. The device according to claim 1 wherein said support devices have bearing surfaces for said ice cubes (1) wherein said surfaces are arranged in an angle to the horizontal in the same direction as said conveyor slides (11, 16, 17, 46).

6. The device according to claim 1 further comprising water removal means (10) for removing excess water from the contact surfaces of said ice cubes (1) before formation of the composite ice cube (1 (a+b)).

7. The device according to claim 6 wherein the water removal means (10) comprises a source of compressed air and at least one compressed air nozzle (10A) for directing compressed air towards said bearing surfaces.

8. The device according to claim 7 comprising temperature control means for maintaining the temperature of said compressed air above 0° C.

9. The device according to claim 1 further comprising a stamping punch (26) located below said support surfaces pressable onto at least one of said contact surfaces.

10. The device according to claim 9, said stamping punch (26) comprising an adjustable output heating means.

11. The device according to claim 9 wherein said stamping punch (26) comprises a leveling plate (28) surrounding said stamping surface and temperature control means for maintaining the surface of said plate at a temperature above 0° C.

12. The device according to claim 11 wherein the rear side of said stamping punch (26) is designated as a leveling plate (28) and is placeable against the contact surface which is not to be stamped.

13. The device according to claim 12 wherein the surface of said leveling plate (28) is placeable against at least one of those surfaces of the composite ice cube (1 (a+b)) at which the bearing surfaces of the ice cubes emerge.

14. The device according to claim 1 wherein the surface of each of said ice cubes (1) situated opposite to the cooling surface on said freezing unit (6) is plane—parallel to said cooling surface.

15. The device according to claim 14 further comprising a leveling plate (28) surface and temperature control means for maintaining the surface of said plate at a temperature above 0° C. said plate being placeable at that surface of said ice cube (1) situated opposite to the cooling surface on the freezing unit (6) when said ice cubes are on said freezing unit (6).

16. The device according to claim 1, further comprising a sorting means (14) provided downstream of said freezing unit (6) in the direction of transport of said ice cubes (1) for removing those ice cubes (1) which would be/are located in the support devices in a position other than that in which their planar surface is in the position of mutual contact.

17. The device according to claim 16 comprising means for recycling and returning said removed ice cubes to one of said support devices.

18. The device according to claim 16 wherein said sorting means (14) is formed integrally with said support devices.

19. The device according to claim 1 further comprising means for locating said ice cubes (1) in said support devices with their contact surfaces in a plane parallel position.

20. A device for producing ice cubes comprising a) a freezing unit (51,52) having a plurality of freezing zones (7A, 7B) said freezing zones being accessible from the outside of said freezing unit (51, 52) each one of said freezing zones being designated for the production of one ice cube (1 (a+b)), b) water application means for applying an excess quantity to said freezing zones (7A, 7B) in order to produce clear ice and c) a delivery region (19) for receiving ice cubes (1(a+b)) removed from said freezing unit (51,52) and d) transportion path between said delivery region and said freezing unit comprising two freezing units (51,52) aligned in pairs in their parallel planes wherein those surfaces of said ice cubes (1) which face away from said cooling surface of at least one of said freezing units (51,52) are actable on by means of at least one stamping plate (55) surface said plate comprising temperature control means for maintaining the surface of said plate at a temperature above 0° C.

and wherein said two freezing units (51, 52) are moveable towards one another in such a manner that the planar, moist mutually facing contact surfaces, which face away from said cooling surfaces of said ice cubes are pressable against one another in order to form composite ice cubes (1 (a+b) and further comprising means for cooling said transport path as well as the delivery region (19) itself to a temperature below 0° C.

21. The device according to claim 20 wherein the rear side of said stamping plate (55) is designated as a leveling plate.

22. The device according to claim 20 comprising a water removal means comprising a source of compressed air and at least one compressed air nozzle (32); (60) directed towards said contact surfaces.

23. The device according to claim 20 comprising a water removal means comprising a source of compressed air and at least one compressed air nozzle (32); (60) inclined towards said contact surfaces.

24. The device according to claim 22. further comprising a means for maintaining compressed air in said compressed air nozzle at a temperature above 0° C.

25. The device according to claim 20 wherein those surfaces of said ice cube (1) which face away from the cooling surface of at least one of said freezing units (51, 52) are actable on by means of at least one stamping plate (55) surface comprising temperature control means for maintaining the surface of said plate at a temperature above 0° C.

* * * * *